US005641019A

United States Patent [19]

Stout et al.

[11] Patent Number: 5,641,019

[45] Date of Patent: Jun. 24, 1997

[54] SWAB-RESISTANT SUBTERRANEAN WELL PACKER

[75] Inventors: Gregg W. Stout, Montgomery, Tex.; James T. Matte, Broussard, La.

[73] Assignee: BJ Services Company, U.S.A., Houston, Tex.

[21] Appl. No.: 566,456

[22] Filed: Dec. 1, 1995

Related U.S. Application Data

[63] Continuation of Ser. No. 291,977, Aug. 17, 1994, abandoned.

[51] Int. Cl.[6] ..... E21B 33/128

[52] U.S. Cl. ..... 166/179; 277/188 A

[58] Field of Search ..... 166/118, 179, 166/187; 277/188 A, 157, 162, 163, 164, 34

[56] References Cited

U.S. PATENT DOCUMENTS

| | | | |
|---|---|---|---|
| 1,547,240 | 7/1925 | Steele | 277/34 |
| 2,430,623 | 11/1947 | Taylor, Jr. et al. | 166/179 X |
| 2,738,017 | 3/1956 | Lynes | 277/163 X |
| 4,219,204 | 8/1980 | Pippert | 277/188 |
| 4,326,588 | 4/1982 | McStravick | 166/387 |
| 4,809,989 | 3/1989 | Kernal | 277/163 X |

FOREIGN PATENT DOCUMENTS

| | | | |
|---|---|---|---|
| 972043 | 11/1980 | U.S.S.R. | 166/118 |
| 1684481 | 10/1991 | U.S.S.R. | 166/179 |
| 2140879 | 12/1984 | United Kingdom | 166/179 |
| 9305267 | 3/1993 | WIPO | 166/118 |

*Primary Examiner*—Hoang C. Dang
*Attorney, Agent, or Firm*—Arnold, White & Durkee

[57] ABSTRACT

A swab-resistant packer is disclosed which prevents the packing element from expanding outwardly to cause swabbing during tripping of the apparatus in a subterranean well. Preferably, a metallic or other cable or cord is placed immediate and circumferentially around the exterior of the first and second ends of the packing element to prevent the packing element from moving outwardly away from the first, pre-set retracted position to thereby abate any tendency to swab.

10 Claims, 2 Drawing Sheets

SWAB-RESISTANT SUBTERRANEAN WELL PACKER

This application is a continuation of application Ser. No. 08,291,977, filed Aug. 17, 1994 now abandoned.

BACKGROUND OF THE INVENTION

1. Field of the Invention

The invention relates to a swab-resistant packer device for use in a subterranean well.

2. Brief Description of the Prior Art

During certain operations in a subterranean oil or gas well, such as during a completion or workover procedure, it is commonplace to utilize a packer assembly, bridge plug, or other isolation tool to separate one section or zone of a well from another section or zone. As used herein, the phrase "packer apparatus" includes all such types of tools.

Typically, the packer apparatus will be introduced and/or withdrawn from the well upon a conduit, such as a wireline, cable, or, more particularly, a cylindrical production or workstring through which fluids are introduced and/or withdrawn from the well during certain procedures involved in the completion and/or workover technique. To such conduit is secured at a given location thereon the packing apparatus. The conduit then is introduced into the well concentrically through another cylindrical conduit, which may be casing, or a larger inner diameter production or work string.

The packer apparatus will have an elastomeric sealing element disposed thereon which may be manipulated by hydraulic, mechanical, or electric means to urge the elastomeric seal to expand outwardly into a sealing engagement along the inner diameter of the second or outer conduit, such as the inner smooth wall of casing. In such "set" position, the primary sealing element of the packer apparatus will prevent transmission of fluids there across to isolate one portion of the well from another portion of the well within the annular area defined between the inner diameter of the outer conduit and the outer diameter of the inner conduit.

It is quite desirable to run the packer apparatus into and out of the well as quickly as possible, in order to reduce the time of a trip into and/or out of the hole to thereby reduce labor and other rig costs. In many cases, a trip into or out of a subterranean well with a packer apparatus, as above described, will be delayed because of "swabbing" of the sealing means of the packer apparatus onto the inner diameter of the outer conduit, or casing. Although not fully understood, it is believed that when fluid within the well and carded within the annular area between the inner and outer conduit members rushes over the top of the outsides of the packing seal during movement of the inner, or production or work conduit, it acts similar to an air flow resulting in the presence of a higher velocity fluid on the outside of the packing element and a slower velocity fluid around the interior of such packing element, thus causing a considerable pressure drop that urges the packing element outwardly to form a temporary seal with the wall of the outer conduit. When so sealed, the inner conduit, when moved, swabs or carries fluid with it. This, in turn, results in a substantial reduction in the rate of movement of the production string through the well.

The present invention is directed to abating the problems associated with such "swabbing" problems during insertion or removal of a packer apparatus within a subterranean well.

Applicant is aware of U.S. Pat. No. 4,326,588, entitled "Well Tool Having Knitted Wire Mesh Seal Means And Method Of Use Thereof", and U.S. Pat. No. 4,219,204, entitled "Anti-Extrusion Seals And Packings".

BRIEF DESCRIPTION OF ILLUSTRATIONS

SUMMARY OF THE INVENTION

The present invention provides a swab-resistant packer apparatus which is adaptable for insertion on a first conduit and which is movable through a second conduit concentrically disposed relative to the first conduit within a subterranean well. The packer apparatus comprises a housing communicable to the first conduit and including a cylindrical mandrel. An elastomeric packing means has first and second ends and further defines an exterior circumferentially extending therearound which faces the second conduit. The packing means is carried exteriorly relative to the mandrel and is movable from a first, pre-set retracted position to a second, expanded position into sealing relation relative to the second conduit to thereby prevent fluid transmission there across. Means are placed immediate and circumferentially around the exterior of the first and second ends to prevent the packing means from moving outwardly away from the mandrel toward the second conduit when the swab resistant apparatus is moving through the second conduit and, concurrently, when the sealing means is in the first, pre-set retracted position. By providing such packing means for the packer apparatus, "swabbing" of the well during tripping is abated.

DESCRIPTION OF THE PREFERRED EMBODIMENTS

Figure 1:
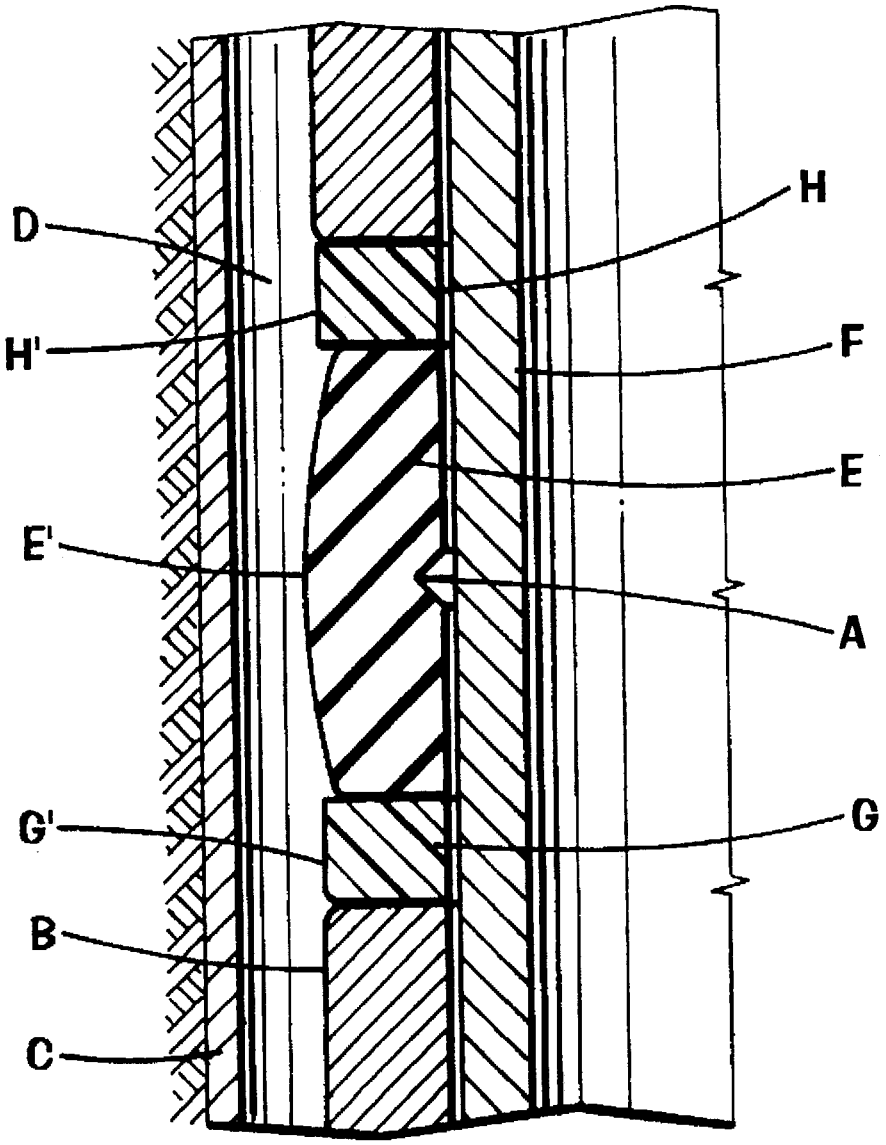
FIG. 1 (PRIOR ART)
FIG. 1 is a schematic illustration of a typical and conventional prior art packer being shown in run-in position, with the sealing element of the packer being urged outwardly toward the second conduit or casing wall thus resulting in "swabbing" of the well.

Now referring to FIG. 1, which is a description of a representative prior art device, there is shown a packer apparatus A carried on a first or inner conduit B concentrically disposed within a second conduit, such as casing C, thereby defining an annular area D therebetween. The packer as shown in FIG. 1 contains a circumferentially extending element E carried around a control mandrel F with upper and lower gauge rings G and H, respectively. Since no means have been provided in the device shown in prior art FIG. 1 to prevent the sealing element E from being urged outwardly of the outer face G', H', the elastomeric packing component E will thus have its outer surface E' circumferentially extended away from the outer surfaces G', H' of the gauge rings G, H, and into the annular area D toward the inner wall of the casing C. In many instances, the outer surface E' will actually contact the wall of the casing C to thereby form a temporary seal within the annular area D. The temporary seal then moves or compresses well fluid which slows or prevents movement of the packer apparatus. In some cases the elastomeric packing element is hydraulically forced off the packer apparatus. This results in what is commonly referred to as "swabbing".

Figure 2:
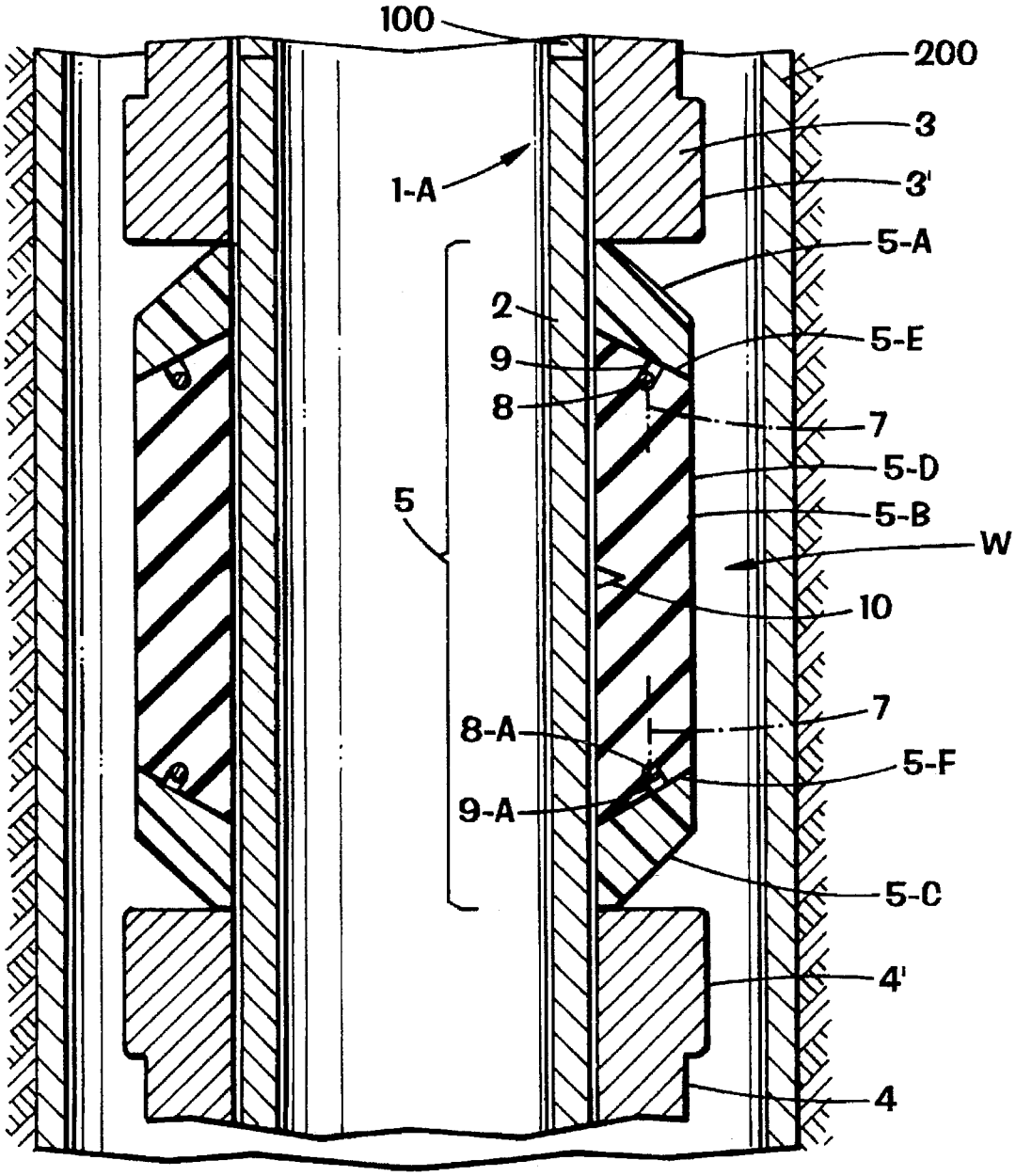
FIG. 2 is a vertical quarter sectional view of the apparatus of the present invention shown in run-in position within the subterranean well.

Now referring to FIG. 2, there is shown a packer apparatus 1 including a housing 1-A with a mandrel 2. The housing 1-A is communicable with a first conduit 100. The mandrel 2 is functional during the setting and/or unsetting of the packer within the subterranean well. The packer apparatus 1 is carded into the subterranean well W on the first conduit 100 which is concentrically and interiorly disposed within a second conduit 200, such as casing.

In a still more preferred embodiment, the packer apparatus 1 is shown as being of the typical three-piece element design having upper and lower seal rings 5-A, 5-C, and a main elastomeric packing element 5B sandwiched therebetween. Members 5-A, 5-C, and 5-B thus combine to form the elastomeric packer means 5. Upper and lower gauge rings 3 and 4 are provided in known fashion and may be actually a part of the packer apparatus 1, or may be provided as a separate auxiliary component on the mandrel 2, or housing 1-A. The upper and lower seal rings 5A and 5-C serve primarily as anti-extrusion barriers relative to the main packer 5-B such that upon sealing, the main packing element 5-B does not extrude across either the upper or lower gauge rings 3 and 4.

An inflection point 10 of pyramid shape is provided approximate the middle vertical length of the main packer 5-B to permit the main packer 5-B to flex during setting and unsetting.

The main packer 5-B has an exterior surface 5-D which, during the pre-set position while making up the packer 1 onto to the first conduit 100, is in substantial vertical alignment with the outer edges 3' and 4' of the upper and lower gauge rings 3, 4, respectively. However, the surface 5-D is radially inward, slightly relative to the surfaces 3' and 4'. The main packer element 5-B also has first and second ends 5-E and 5-F. Upon the outer surface thereof is carried circumferentially and horizontally there around a continuous metal or other cable or line 8 and 8-A, preferably shown in a retainer means 9, 9-A, defined within "U"-shaped grooveways being angularly and horizontally offset from a vertical axis 7.

As shown, the retainer means 9, 9-A are grooveways and grooveways are horizontally angularly disposed from the vertical axis 7 such that the closed or looped end of the "U"-shaped grooveways is slightly further inwardly toward the mandrel 2 than is the open or head of the "U"-shaped grooveways. Of course, the grooveways 9, 9-A with the cables 8, 8-A disposed therein may be filled with epoxy, resin, or other material to assure that contaminants which might otherwise interfere with the setting and retrieving operation of the packer 1 do not fill the balance of the grooveway 6 outwardly of the cable or line 8.

During manufacture of the packer 1, the main packer 5-B of the elastomeric packer means is made up by first engrooving by molding, machining, or etching the grooveways 9, 9-A around the first and second ends 5-E, 5-F, and by placing a clamp around the main packer 5-B to compress the elastomer thereof. With the elastomer 5-B so compressed, the upper and lower cables 8 and 8-A are placed within the respective grooveways 6 and 6-A and the clamp removed. The cable or lines 8 and 8-A now mechanically and compressively urge the main packer 5-B toward the mandrel 2. Alternatively, the swab-resisting means may be molded or otherwise placed within the interior of the main packing element 5-B.

It will be appreciated that the geometric configuration of the grooveways 9 and 9-A is one of preference. Ninety degree offset wall constructed retainer means 9, 9-A could also be utilized. Likewise, the particular construction of the cable or lines 8 and 8-A is not critical to the invention, but such cable or line should be continuous in length completely around the main packer 5-B first and second ends 5-E and 5-F, and be manufactured from such material so as to apply such hoop strength to the main packer 5-B to apply sufficient compressive load thereon, yet permit satisfactory sealing of the packer element 5-B when the apparatus 1 is in "set" position.

The geometry of the cables 8, 8-A should conform to that of the geometry of the grooveways 9, 9-A and may be either circular, square, triangularly shaped, or the like. The cables 8, 8-A preferably are made of strong metallic material which is capable of withstanding the high temperatures and pressures involved in the operations in the subterranean well W requiring a packer 1. A satisfactory cable is that known as "plasticable" manufactured by the Cable Manufacturing & Assembly Co., Inc. of Rockaway, N.J.

Although the invention has been described in terms of specific embodiments which have been set forth in detail, it should be understood that this is by illustration only and that the invention is not necessarily limited thereto. Since alternative embodiments and operation techniques will become apparent to those skilled in the art in view of the disclosure. Accordingly, modifications are contemplated which can be made without departing from the spirit of the described invention.

What is claimed and desired to be secured by Letters Patent is:

1. A swab-resistant packer apparatus comprising:
a packer mandrel;
an elastomeric sealing element disposed about said packer mandrel, said elastomeric sealing element including:
a substantially flat upper outer surface having a first groove formed therein between its uppermost and lowermost end; and
a substantially flat lower outer surface having a second groove formed therein between its uppermost and lowermost ends;
a first cable disposed within a first groove; and
a second cable disposed within said second groove.

2. The swab-resistant packer apparatus of claim 1, wherein said upper outer surface is substantially frusto-conical, and wherein said lower outer surface is substantially frusto-conical.

3. The swab-resistant packer apparatus of claim 1, wherein said elastomeric sealing element further includes an intermediate outer surface positioned between said upper outer surface and said lower outer surface.

4. The swab-resistant packer apparatus of claim 3, wherein said intermediate outer surface is substantially cylindrical.

5. The swab-resistant packer apparatus of claim 3 wherein said upper outer surface is substantially frusto-conical, and wherein said lower outer surface is substantially frusto-conical.

6. The swab-resistant packer apparatus of claim 1, wherein said upper outer surface is inclined at an angle relative to a longitudinal axis of said packer apparatus and said lower outer surface is inclined at an angle relative to said longitudinal axis of said packer apparatus.

7. A swab-resistant packer apparatus, comprising:
a packer mandrel;
an upper gauge ring disposed about said packer mandrel;
a lower gauge ring disposed about said packer mandrel;
an elastomeric sealing element disposed about said packer mandrel and positioned between said upper gauge ring and said lower gauge ring, said elastomeric sealing element including:
an upper frusto-conical outer surface having a first groove;

a lower frusto-conical outer surface having a second groove; and an intermediate cylindrical outer surface positioned between said upper frusto-conical outer surface and said lower frusto-conical outer surface;

a first cable disposed within said first groove;

a second cable disposed within said second groove;

an upper seal ring disposed about said packer mandrel and positioned adjacent to said upper frusto-conical surface of said elastomeric sealing element; and a lower seal ring disposed about said packer mandrel and positioned adjacent to said lower frusto-conical surface of said elastomeric sealing element.

8. A swab-resistant packer apparatus, comprising:

a packer mandrel;

an elastomeric sealing element disposed about said packer mandrel, said elastomeric sealing element including:

a substantially frusto-conical upper outer surface having a first groove; and a substantially frusto-conical lower outer surface having a second groove;

a first cable disposed within said first groove; and a second cable disposed within said second groove.

9. The swab-resistant packer apparatus of claim 8, wherein said elastomeric sealing element further includes an intermediate outer surface positioned between said upper outer surface and said lower outer surface.

10. The swab-resistant packer apparatus of claim 9, wherein said intermediate outer surface is substantially cylindrical.

* * * * -*

UNITED STATES PATENT AND TRADEMARK OFFICE

CERTIFICATE OF CORRECTION

PATENT NO. : 5,641,019

DATED : June 24, 1997

INVENTOR(S) : Gregg W. Stout and James T. Matte

It is certified that error appears in the above-identified patent and that said Letters Patent is hereby corrected as shown below:

In column 1, line 50, change "carded" to --carried--.

In column 3, line 1, change "carded" to --carried--.

In column 3, line 48, after the word "means" add --5--.

In the claims at column 4, line 36, delete the second "a" replace with --said--.

In the claims at column 4, line 49, after "3" add --,--.

Signed and Sealed this

Second Day of December, 1997

*Attest:*

*Attesting Officer*

Bruce Lehman

BRUCE LEHMAN

*Commissioner of Patents and Trademarks*